US005860801A

United States Patent [19]

Timuska

[11] Patent Number: 5,860,801

[45] Date of Patent: Jan. 19, 1999

[54] ROTARY SCREW COMPRESSOR WITH UNLOADING MEANS

[75] Inventor: Karlis Timuska, Spånga, Sweden

[73] Assignee: Svenska Rotor Maskiner AB, Stockholm, Sweden

[21] Appl. No.: 849,176

[22] PCT Filed: Nov. 28, 1995

[86] PCT No.: PCT/SE95/01418

§ 371 Date: May 28, 1997

§ 102(e) Date: May 28, 1997

[87] PCT Pub. No.: WO96/17175

PCT Pub. Date: Jun. 6, 1996

[30] Foreign Application Priority Data

Nov. 30, 1994 [SE] Sweden ..... 9404150

[51] Int. Cl.[6] ..... F04C 18/16; F04C 23/00; F04C 29/10

[52] U.S. Cl. ..... 418/9; 418/201.2; 417/310

[58] Field of Search ..... 418/9, 201.2; 417/310

[56] References Cited

U.S. PATENT DOCUMENTS

| | | | |
|---|---|---|---|
| 2,358,815 | 9/1944 | Lysholm | 418/9 |
| 4,453,900 | 6/1984 | Schibbye et al. | 418/201.2 |
| 4,498,849 | 2/1985 | Schibbye et al. | 417/310 |
| 4,946,362 | 8/1990 | Söderlund et al. | 418/201.2 |

FOREIGN PATENT DOCUMENTS

| | | | |
|---|---|---|---|
| 62-688 | 1/1987 | Japan | 418/9 |
| 4-1487 | 1/1992 | Japan | 418/201.2 |
| 1 576 230 | 10/1990 | United Kingdom . | |

OTHER PUBLICATIONS

Patent Abstracts of Japan, vol. 10, No. 6, M–445, abstract of JP A 60–169694 (Nippon Denso K.K.), 3 Aug. 1985.

*Primary Examiner*—John J. Vrablik
*Attorney, Agent, or Firm*—Frishauf, Holtz, Goodman, Langer & Chick

[57] ABSTRACT

A rotary screw compressor having one or more stages (10, 20) is provided with a lift valve (14, 24) on each stage for unloading the compressor at starting up and rest periods. Each lift valve (14, 24) is biased by a spring (15, 25) towards an open position and can be closed by an actuator (17, 27). Each valve actuator (17, 27) is automatically controlled by an air conduit (32) establishing air communication between the discharge channel (23) of the compressor and each valve actuator (17, 27).

12 Claims, 1 Drawing Sheet

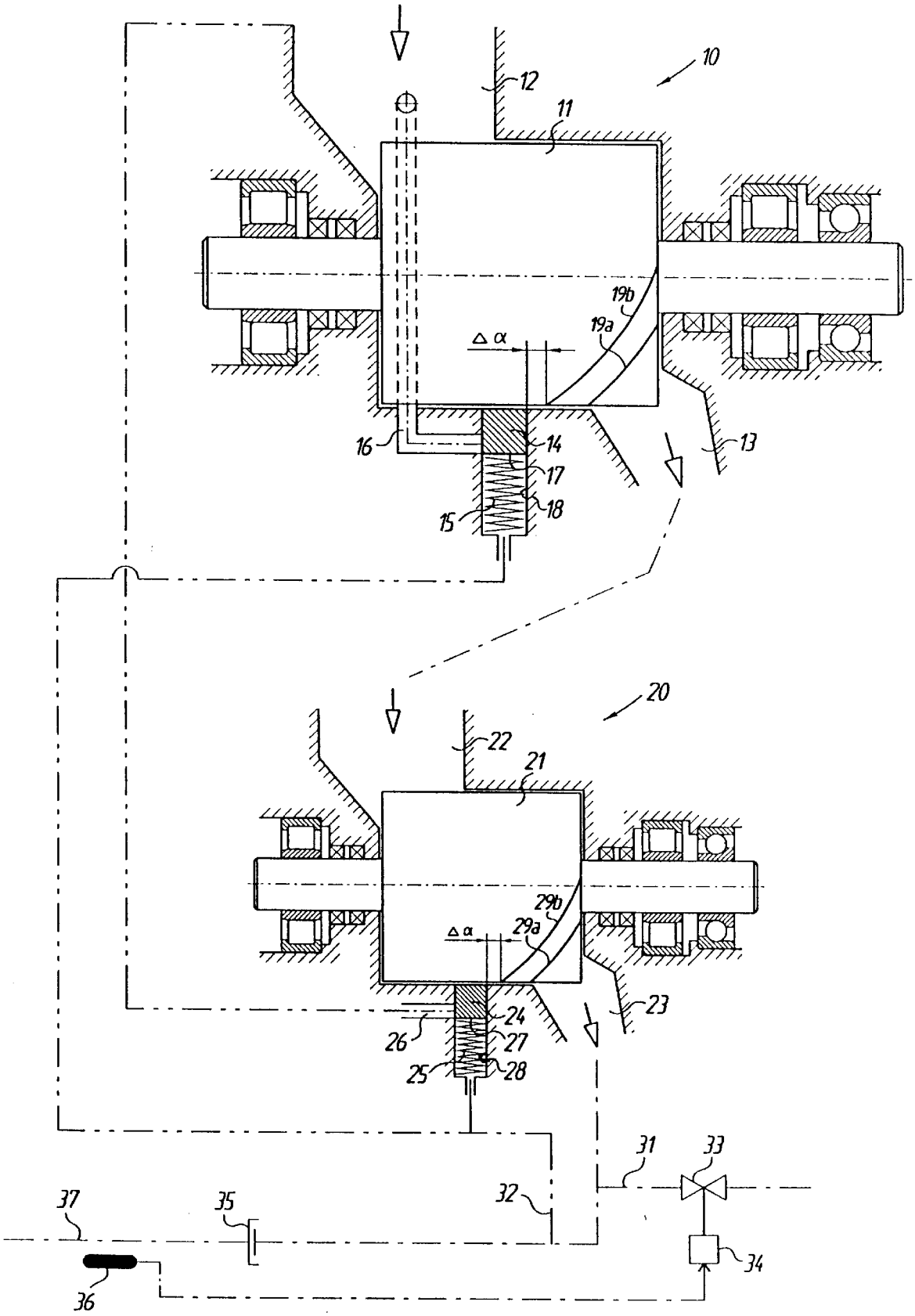
10
12
11
19b
19a
Δα
16
14
17
18
15
13
20
22
21
29b
29a
Δα
24
27
28
25
26
23
31
33
32
37
35
34
36

ROTARY SCREW COMPRESSOR WITH UNLOADING MEANS

BACKGROUND OF THE INVENTION

The present invention relates to a rotary screw compressor having at least one stage and each stage being provided with at least one relief lift valve.

It is common to provide rotary screw air compressors with devices for unloading the compressor at starting up and at periods with low demand on compressed air. Therethrough the power consumption can be reduced. A frequently used method is to throttle the compressor inlet channel down to about 10% of the normal inlet pressure. Although a certain amount of drive energy can be saved this way there still remains a considerable work to compress the air. Another solution is to provide the wall of the working space with valve controlled openings for reducing the capacity and the internal volume ratio ($V_i$) of the compressor during the starting up periods as disclosed in GB-1 576 230. This disclosure, however, does not mention anything about the valve arrangement for the openings. Normally such openings are provided with so called lift valves as disclosed in U.S. Pat. No. 4,453,900. The lift valves in U.S. Pat. No. 4,453,900 are, as is the common way, actuated by oil pressure, which is relatively complicated, requiring circumstantial measures for manufacturing and maintenance.

OBJECT AND SUMMARY OF THE INVENTION

The object of the present invention is to provide a rotary screw compressor with an unloading system through which a high degree of power saving is attained and which is simple and reliable.

By unloading through lift valves a higher degree of power savings can be reached than through inlet throttling, since only a small amount of air is compressed and with a low pressure increase. By actuating the lift valves pneumatically with the air in the discharge channel as the air source a very simple regulation of the valves is attained and the valves will close and open automatically in response to the air pressure in the discharge channel.

The advantages of the invention will be of particular importance when applied to a multi-stage compressor.

According to the invention a branch conduit ending in ambient air is connected to the discharge channel and is provided with a valve. By controlling this valve in dependence of the pressure in the delivery conduit, unloading of the compressor at reduced or interrupted demand of compressed air can be established automatically.

The invention will be explained through the following detailed description of a preferred embodiment thereof with reference to the accompanying drawing which schematically illustrates a two-stage compressor according to the invention.

BRIEF DESCRIPTION OF THE DRAWING

The illustrated compressor has a first stage 10 and a second or end stage 20. The first stage 10 has an inlet channel 12 for air and an outlet channel 13 connected to the inlet channel 22 of the end stage 20. The air leaves the end stage 20 through the discharge channel 23 connected to the delivery conduit 37 via a check valve 35.

DETAILED DESCRIPTION

In each stage the air is compressed by a pair of meshing screw rotors of which only one 11, 21 can be seen in each stage. The rotors 11, 21 have helically extending lobes and intermediate grooves through which they mesh with the related rotor forming chevron-shaped working chambers. A working chamber is limited by a forerunning and afterrunning sealing line, each sealing line consisting of portions formed between the rotors and between each rotor and the walls of the working space. In the figure the forerunning sealing line 19*a*, 29*a* and the afterrunning sealing line 19*b*, 29*b* are indicated for a working chamber in a position immediately before being brought into communication with the outlet. Each chamber initially during a filling phase communicates with the inlet, thereafter during a compression phase defines a closed space with decreasing volume as the chamber travels towards the outlet and finally during a discharge phase communicates with the outlet. The ratio between the volume of a working chamber immediately after communication with the inlet has been cut off and the volume of a working chamber immediately before it is brought into communication with the outlet is defined as the internal volume ratio, $V_i$.

The first stage 10 is provided with a lift valve 14 in the barrel wall of the compression space, through which the $V_i$ and the capacity of the stage can be reduced. In closed position the valve 14 conforms with the barrel wall and seals against the lobe tips of the rotor 11, thereby establishing full $V_i$=2.2. In open position the lift valve 14 is raised from the rotor 11 and opens communication between otherwise closed working chambers and the inlet channel through a return channel 16. The lift valve 14 extends axially far enough to the left in the figure for facing also working chambers still being at the filling phase. A return flow therefore also is established across the rotor lobe tips from the compression-phase chambers to the filling-phase chambers. The degree of compression at open lift valve will be determined by the angular distance $\Delta\alpha$, which is the distance an afterrunning sealing line travels from the position at which it ceases to face the valve opening until the position at which the related forerunning sealing line reaches the outlet. The $V_i$ of the first stage 10 is about 1.2 when the lift valve is open.

The above description of the first stage 10 to a large extent also relates to the end stage 20. However, the return channel 26 of the end stage 20 does not end in the inlet channel 22 of this stage but in the inlet channel 12 of the first stage 10. When the lift valve 24 is open the compression in the end stage 20 thus starts at a pressure level equalizing the pressure in the first stage inlet channel 12. The valve opening of valve 24, like that of valve 14, faces also working chambers that still is in the filling phase. Therefore the pressure of the first stage inlet channel 12 will prevail also in the end stage inlet channel 22 due to the communication through return channel 26 when the lift valve 24 is open.

The purpose of the lift valves 14, 24 is to unload the compressor at starting up and at periods when the demand of compressed air is reduced or interrupted. With the valves open only a small amount of air is compressed since the volume of a working chamber when compression starts is considerably reduced and the compressing rate is low. In principle the $V_i$ could be as low as almost 1.0 but it is desirable to have a somewhat higher $V_i$, in order to maintain a certain minimum load on the bearings of the rotors also when the compressor runs unloaded. And the power savings that could be attained by further reducing the $V_i$ below 1.3 are practically negligible.

According to the invention an automatically controlled actuating system is provided for maintaining the valves 14, 24 open when unloading is required, but otherwise closed.

This system will be explained with reference to the lift valve 14 of the first stage 10 but relates to that of the end stage as well. The lift valve 14 takes the form of a piston in a pneumatic cylinder 18 and has a pressure surface 17 exposed to the pressure in the cylinder. A mechanical tension spring is attached to the valve 14 and tends to raise the valve from the closed position. At start the lift valve 14 is affected solely by the tension spring 15 and the force is large enough to keep the valve open.

This discharge channel 23 of the end stage is provided with a branch conduit 31, through which the discharge channel can be vented to ambient by means of a shut-off valve 33. At start this valve is closed as is also the check valve 35 connecting the discharge channel 23 to the delivery conduit 37. At starting up an over-pressure therefor will be built up in the discharge channel. This pressure is transmitted to the pneumatic cylinders 18 and 28 of the lift valves 14, 24, respectively. When the pressure has reached a certain level the force on the pressure surfaces 17, 27 of the lift valves will be large enough to close the valves against the action of the related spring 15, 25, respectively, with the result that the compressor will start to operate at full capacity and $V_i$ and force the check valve 35 to open for delivery of the air to the consumer.

The shut-off valve 33 in the branch conduit 31 is regulated to a closed or open position by a valve positioning device 34 which can be of the electromagnetic or hydraulic type. The positioning device is controlled by a pressure sensor 36 sensing the pressure in the delivery conduit 37. The valve positioning device 34 is arranged to open the valve 33 when the pressure in the delivery conduit 37 exceeds a certain value and to close it when the pressure is below a certain value which is somewhat lower.

Should a reduction or interruption of the demand for compressed air occur, the pressure in the delivery conduit 37 rises with the result that the valve 33 opens in response to the increased pressure sensed by the pressure sensor 36. The discharge channel 23 therethrough becomes vented to ambient and the check valve closes due to the pressure fall on its upstream side. The low pressure in the discharge channel 23 is transmitted through the conduit 32 to the pressure surfaces 17, 27 of the lift valves 14, 24, respectively, and these will open so that the compressor starts to run unloaded.

When full demand for compressed air recurs the pressure in the delivery conduit 37 falls causing the shut-off valve 33 to close in response to the lower pressure sensed by the pressure sensor 36. Short thereafter the lift valves 14, 24 will close due to the pressure built up in the discharge channel 23 when the shut-off valve 33 is closed, and the compressor will deliver compressed air again.

I claim:

1. A rotary screw compressor comprising:

at least one stage, including an end stage (20) with an air discharge channel (23), each stage (10, 20) being provided with at least one relief lift valve (14, 24) having an open and a closed position, in which open position the internal volume ratio $V_i$ of the related stage is reduced, each said lift valve (14, 24) being provided with a spring (15, 25) and an actuator (17, 27), said spring (15, 25) biasing the related lift valve (14, 24) with a force towards the open valve position and said actuator (17, 27) being responsive to a control unit to close the related lift valve (14, 24) in dependence of operation of said control unit, wherein said control unit comprises:

a communication conduit (32) establishing communication for air between said discharge channel (23) and each said actuator (17, 27); and a branch conduit (31) in communication with said discharge channel (23) and ending in ambient air;

said branch conduit (31) being provided with a valve (33) which is coupled to a valve positioning unit (34);

said discharge channel (23) being connected to a delivery conduit (37) through a check valve (35); and wherein said delivery conduit (37) is provided with a pressure sensor (36), said pressure sensor (36) controlling said valve positioning unit (34) to control the position of said valve (33) of said branch conduit (31).

2. A compressor according to claim 1, including at least two stages (10, 20).

3. A compressor according to claim 1, wherein;

each said spring (15, 25) comprises a mechanical tension spring; and each said actuator (17, 27) comprises a pneumatic piston device connected to the related lift valve (14, 24) and having a pressure surface (17, 27) exposed to the air in said communication conduit (32).

4. A compressor according to claim 1, wherein each said stage (10, 20), when its lift valve (14, 24) is in an open position, has an internal volume ratio in the range $1.0<V_i<1.4$.

5. A compressor according to claim 1, wherein said valve positioning unit (34) is arranged to open said valve (33) of said branch conduit (31) when a pressure sensed by said pressure sensor (36) exceeds a predetermined first level, and to close said valve (33) of said branch conduit (31) when said sensed pressure falls below a predetermined second level.

6. A compressor according to claim 2, wherein:

each said spring (15, 25) comprises a mechanical tension spring; and each said actuator (17, 27) comprises a pneumatic piston device connected to the related lift valve (14, 24) and having a pressure surface (17, 27) exposed to the air in said communication conduit (32).

7. A compressor according to claim 2, wherein each said stage (10, 20), when its lift valve (14, 24) is in an open position, has an internal volume ratio in the range $1.0<V_i<1.4$.

8. A compressor according to claim 2, wherein said valve positioning unit (34) is arranged to open said valve (33) of said branch conduit (31) when a pressure sensed by said pressure sensor (36) exceeds a predetermined first level, and to close said valve (33) of said branch conduit (31) when said sensed pressure falls below a predetermined second level.

9. A compressor according to claim 3, wherein said valve positioning unit (34) is arranged to open said valve (33) of said branch conduit (31) when a pressure sensed by said pressure sensor (36) exceeds a predetermined first level, and to close said valve (33) of said branch conduit (31) when said sensed pressure falls below a predetermined second level.

10. A compressor according to claim 4, wherein said valve positioning unit (34) is arranged to open said valve (33) of said branch conduit (31) when a pressure sensed by said pressure sensor (36) exceeds a predetermined first level, and to close said valve (33) of said branch conduit (31) when said sensed pressure falls below a predetermined second level.

11. A compressor according to claim 6, wherein said valve positioning unit (34) is arranged to open said valve (33) of said branch conduit (31) when a pressure sensed by said pressure sensor (36) exceeds a predetermined first level, and to close said valve (33) of said branch conduit (31) when said sensed pressure falls below a predetermined second level.

12. A compressor according to claim 7, wherein said valve positioning unit (34) is arranged to open said valve (33) of said branch conduit (31) when a pressure sensed by said pressure sensor (36) exceeds a predetermined first level, and to close said valve (33) of said branch conduit (31) when said sensed pressure falls below a predetermined second level.

* * * * *